US008807336B2

(12) United States Patent
McGuire

(10) Patent No.: US 8,807,336 B2
(45) **Date of Patent: *Aug. 19, 2014**

(54) GOLF BAG ASSEMBLY HAVING A MAIN BAG AND A REMOVABLE ACCESSORY BAG

(75) Inventor: Robert McGuire, Orland Park, IL (US)

(73) Assignee: Mulligan 7, LLC, Orland Park, IL (US)

( * ) Notice: Subject to any disclaimer, the term of this patent is extended or adjusted under 35 U.S.C. 154(b) by 13 days.

This patent is subject to a terminal disclaimer.

(21) Appl. No.: 13/486,565

(22) Filed: Jun. 1, 2012

(65) Prior Publication Data

US 2012/0234707 A1 Sep. 20, 2012

Related U.S. Application Data

(63) Continuation of application No. 12/866,218, filed as application No. PCT/US2009/035103 on Feb. 25, 2009, now Pat. No. 8,201,686.

(60) Provisional application No. 61/032,754, filed on Feb. 29, 2008.

(51) Int. Cl.
*A63B 55/06* (2006.01)
*A63B 55/08* (2006.01)

(52) U.S. Cl.
USPC ..... 206/315.3; 206/315.6; 206/315.7

(58) Field of Classification Search
USPC ..... 206/315.2, 315.3, 315.5, 315.6, 315.7
See application file for complete search history.

(56) References Cited

U.S. PATENT DOCUMENTS

| | | | |
|---|---|---|---|
| 4,927,052 | A | 5/1990 | Marthaler et al. |
| 5,358,109 | A | 10/1994 | Nichols |
| 5,472,084 | A | 12/1995 | Aliano, Jr. |
| 5,474,175 | A | 12/1995 | Gattis |
| 5,632,496 | A | 5/1997 | Nelson |
| D382,707 | S | 8/1997 | Wang |
| 5,671,842 | A | 9/1997 | Jaworski |
| 5,918,737 | A | 7/1999 | Kwon |
| D423,222 | S | 4/2000 | Ryan |
| 6,126,050 | A | 10/2000 | Aliano, Jr. |
| D434,905 | S | 12/2000 | Ryan |
| 6,330,944 | B1 | 12/2001 | De Michele |
| 6,375,004 | B1 | 4/2002 | Tuerschmann et al. |
| 6,499,593 | B1 | 12/2002 | Uner et al. |

(Continued)

OTHER PUBLICATIONS

U.S. Appl. No. 12/866,218, filed Aug. 4, 2010.

(Continued)

*Primary Examiner* — Sue A Weaver
(74) *Attorney, Agent, or Firm* — Mark J. Nahnsen; Barnes & Thornburg LLP

(57) ABSTRACT

A golf bag that includes a main bag and an accessory bag coupled to the main bag. The main bag is formed to include a bag-receiver chamber that is configured to accept the accessory bag. The accessory bag is coupled to the main bag by posts that engage a retention slots formed in the side walls of the bag-receiver chamber. The accessory bag is supported by the main bag and includes a foldable leg assembly that permits the accessory bag to be set up in a tripod configuration when separated from the main bag. The golf bag also includes a slot formed in the side walls of the main bag to allow the main bag to be secured to a golf cart by a retaining strap provided on the golf cart while still allowing the accessory bag to be separated from the main bag.

16 Claims, 12 Drawing Sheets

(56) References Cited

U.S. PATENT DOCUMENTS

| | | | | |
|---|---|---|---|---|
| 6,640,970 | B1 | 11/2003 | Townsend | |
| 6,758,334 | B2 | 7/2004 | Uner | |
| 7,044,298 | B1 | 5/2006 | Pryst | |
| 7,059,470 | B2 | 6/2006 | Slankster | |
| 7,077,274 | B2 | 7/2006 | Laud | |
| 7,090,075 | B1 | 8/2006 | Rocha | |
| 7,150,123 | B1 | 12/2006 | Fox | |
| D538,042 | S | 3/2007 | Suggs | |
| 7,222,733 | B2 | 5/2007 | Kim | |
| 7,481,311 | B1 | 1/2009 | Old | |
| 7,549,534 | B1 | 6/2009 | Parpart | |
| 8,201,686 | B2 * | 6/2012 | McGuire | 206/315.7 |
| 2002/0066763 | A1 | 6/2002 | Hsueh | |
| 2004/0108234 | A1 | 6/2004 | Meissner | |
| 2005/0199519 | A1 | 9/2005 | Kim | |
| 2006/0272967 | A1 | 12/2006 | Bremner | |
| 2008/0296185 | A1 | 12/2008 | Polo | |

OTHER PUBLICATIONS

Search Report and Written Opinion issued in Int'l App. No. PCT/US09/35103 (2009).

* cited by examiner

GOLF BAG ASSEMBLY HAVING A MAIN BAG AND A REMOVABLE ACCESSORY BAG

CROSS-REFERENCE TO RELATED PATENT APPLICATIONS

This application is a continuation of U.S. patent application Ser. No. 12/866,218, filed Aug. 4, 2010, now U.S. Pat. No. 8,201,686, which a U.S. nationalization of international patent application no. PCT/US2009/035103, filed Feb. 25, 2009, which claims priority to U.S. Provisional Application Ser. No. 61/032,754, filed Feb. 29, 2008. The disclosures set forth in the referenced applications are incorporated herein by reference in their entireties, including all information as originally submitted to the United States Patent and Trademark Office.

BACKGROUND

The present disclosure relates to golfing, and in particular, to golf bags. More particularly, the present disclosure relates to golf bag accessories. The golf bag accessories are used by the golfer to keep track of their equipment during a game of golf.

SUMMARY

A golf bag, in accordance with the present disclosure, includes a housing provided with a series of compartmentalized openings that are configured to accept the shafts of golf clubs. The housing includes side walls and a bottom wall. The housing may also include one or more pockets adapted to hold golf accessories, such as golf balls, gloves, and tees.

In illustrative embodiments, the golf bag includes a main bag and a built-in removable accessory bag that is coupled to the main bag. The main bag is formed to include a bag-receiver chamber that is configured to accept the accessory bag. The accessory bag is coupled to the main bag by posts that engage a retention slots formed in the side walls of the bag-receiver chamber. The accessory bag is supported by the main bag and includes a foldable leg assembly that permits the accessory bag to be set up in a tripod configuration when separated from the main bag. The golf bag also includes strap slots formed in the side walls of the main bag that allow the main bag to be secured to a golf cart by a retaining strap provided on the golf cart while still allowing the accessory bag to be separated from the main bag.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
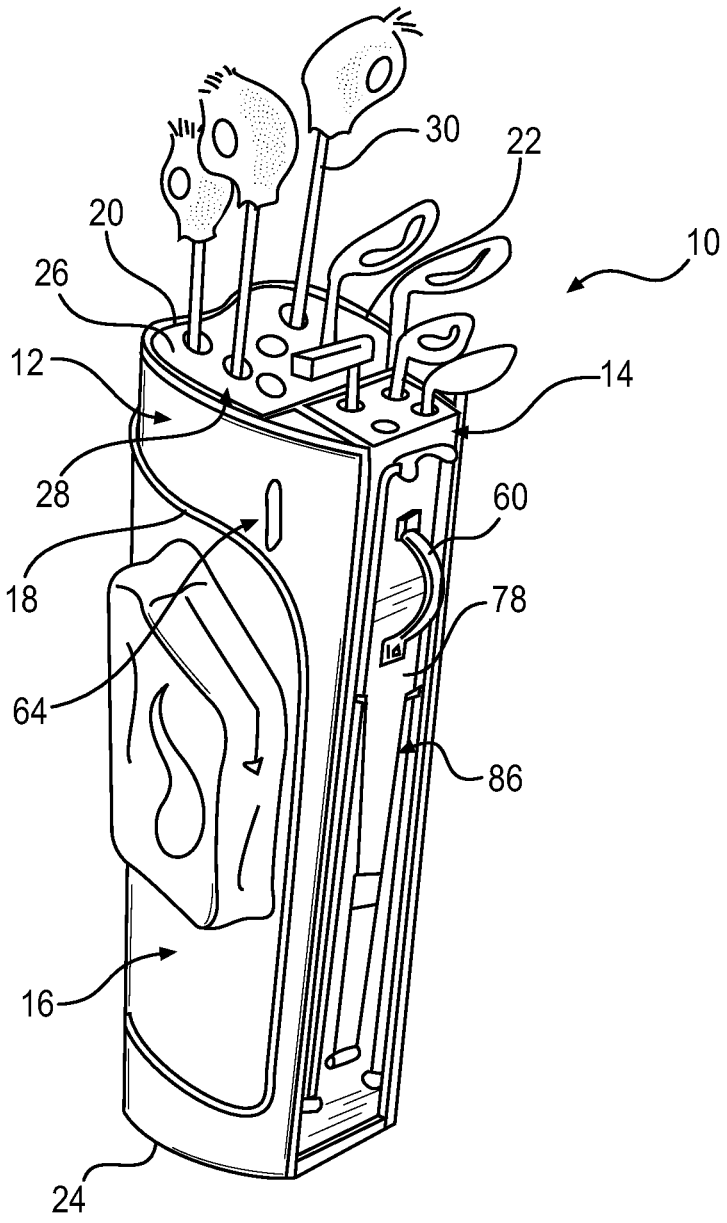
FIG. 1 is a perspective view of a golf bag showing a main bag and an accessory bag positioned within a bag-receiver chamber of the main bag, the main and accessory bags formed to include a series of openings to accept golf clubs and also showing the accessory bag having an arched handle and a pair of support legs that extend vertically along the length of the side wall of the accessory bag.
Figure 2:
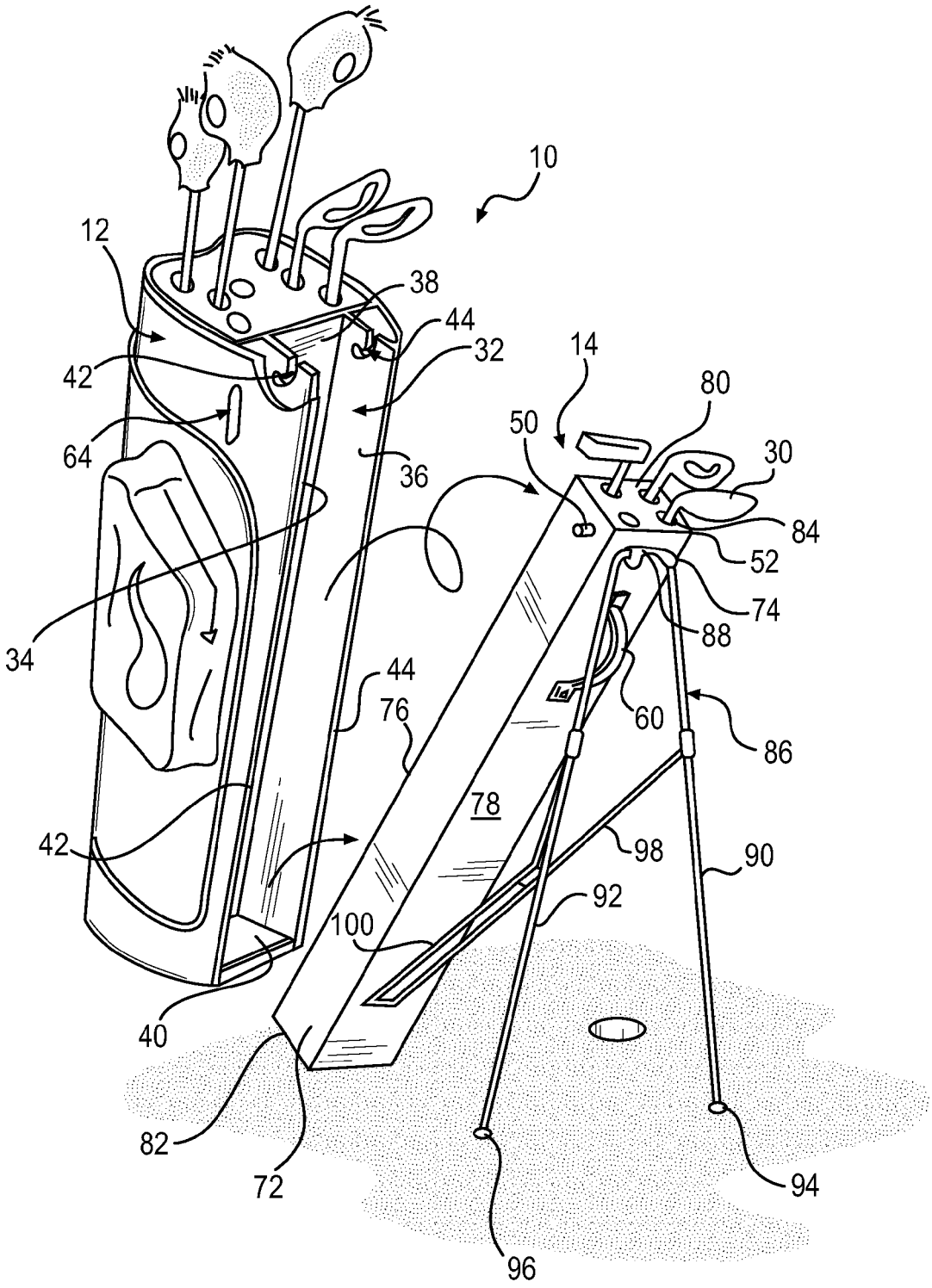
FIG. 2 is a perspective view of the golf bag showing the accessory bag removed from the bag-receiver chamber of the main bag and showing the support legs pivoted outwardly in a use position to support the accessory bag in a tripod type configuration.

A golf bag 10 is shown having a main bag 12 and an accessory bag 14 coupled to main bag 12, as shown, for example, in FIGS. 1 and 2. Main bag 12 includes a housing 16. Housing 16 of main bag 12 includes side walls 18, 20, 22 and bottom wall 24. Housing 16 of main bag 12 also includes a top wall 26. Top wall 26 includes a series of openings 28 that are adapted to accept the shafts of golf clubs 30. Housing 16 of main bag 12 also includes a bag-receiver chamber 32 that is adapted to accept accessory bag 14, as shown, for example, in FIG. 2.

Bag-receiver chamber 32 of main bag 12 includes a first side wall 34, a second side wall 36, and a back wall 38, as shown in FIG. 2. Bag-receiver chamber 32 of housing 16 also includes bottom wall 40. Walls 34, 36, 38, and 40 together form bag-receiver chamber 32 and are adapted to house accessory bag 14. Walls 34, 36 meet with side walls 18, 22 along leading edges 42, 44. While a rectangular chamber is shown it is contemplated that a curved or triangular chamber can also be used to accommodate a complementary accessory bag of similar configuration.

Walls 34, 36 of main bag 12 each include retention slots 46, 48 as shown in FIGS. 2-5. Retention slots 46, 48 are adapted to accept retention pins 50, 52 that extend from accessory bag 14. Each of retention slots 46, 48 is formed to include a first channel 54 and a second channel 56. First channel 54 extends from the top of main bag 12 and extends in a forwardly direction toward second channel 56. Second channel 56 is connected to first channel 54 and curves as it extends from first channel 54 toward the rear of the golf bag 10. Second channel 56 includes a termination point 58 that is slightly elevated above the lowest portion of second channel 56.

Figure 3:
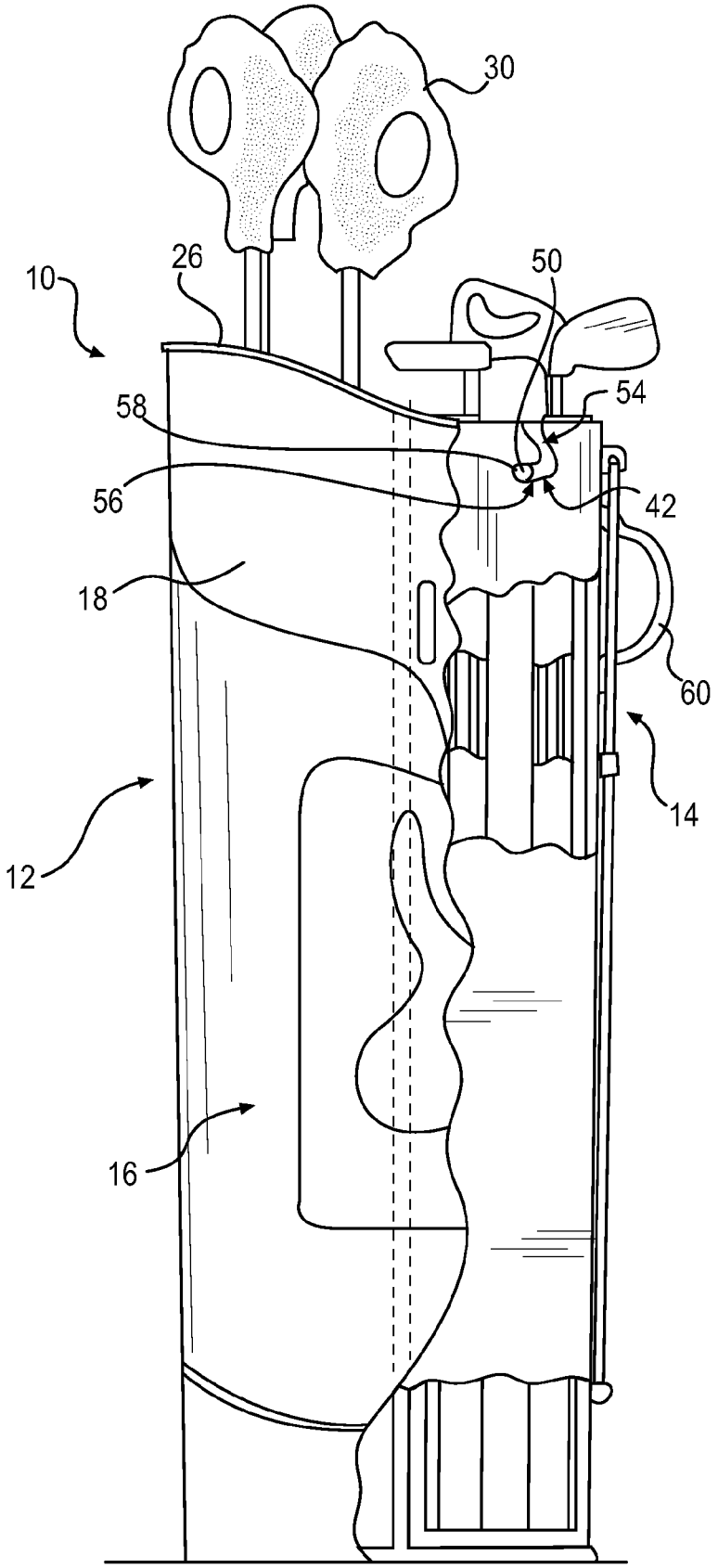
FIG. 3 is a side plan view of the golf bag with portions cut away to show the accessory bag positioned within the bag-receiver chamber of the main bag and secured by use of an L-shaped slot formed in the wall of the bag-receiver chamber and located near the top and front of the bag and a guide post on the side wall of the accessory bag.
Figure 4:
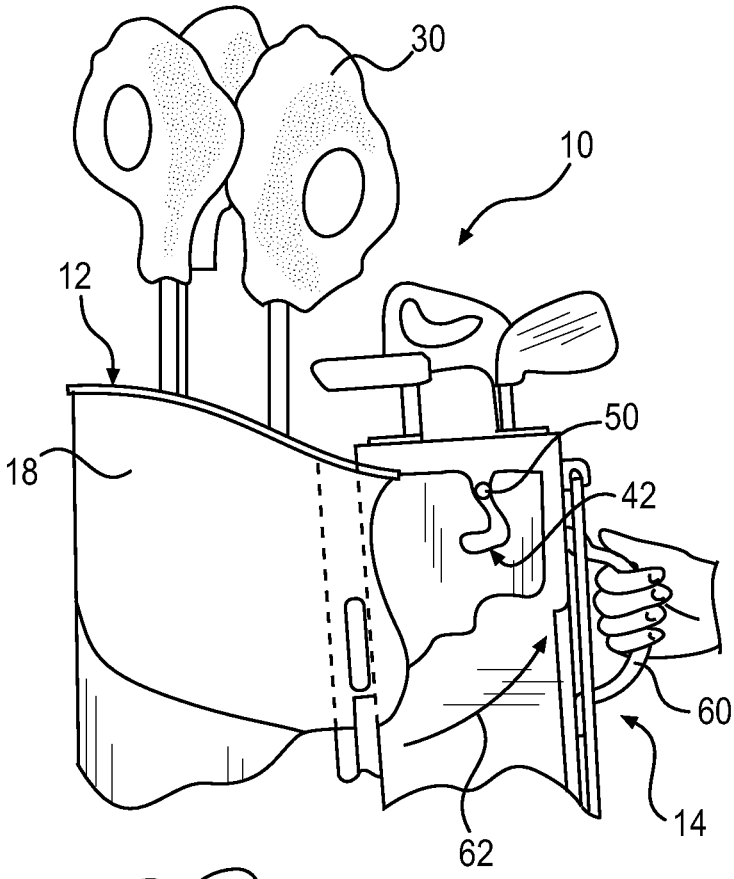
FIG. 4 is a side plan view of the top portion of the golf bag showing a user raising the accessory bag in an upwardly and outwardly direction to remove the accessory bag from the main bag.
Figure 5:
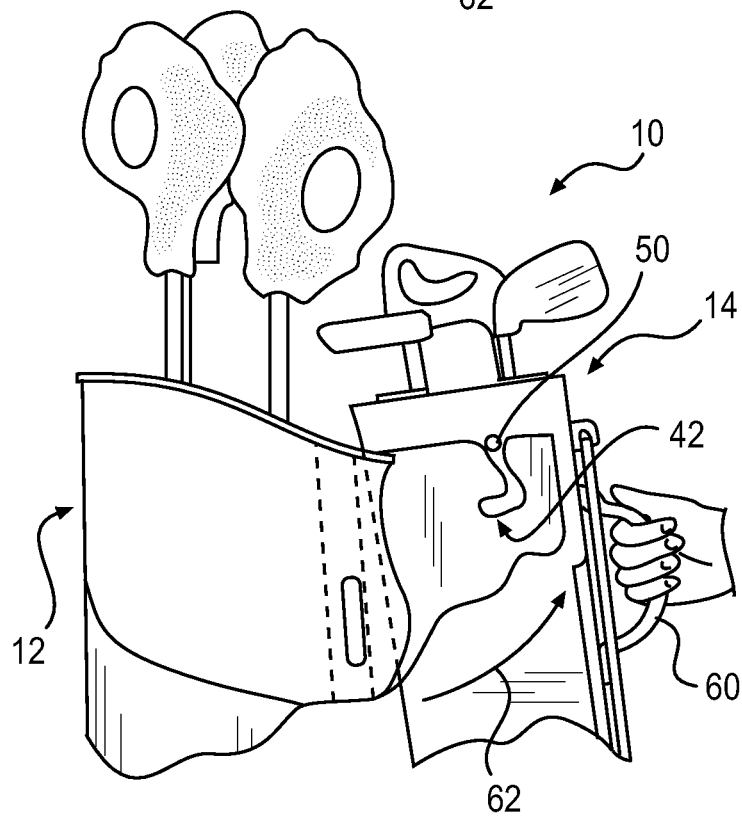
FIG. 5 is a side plan view similar to FIG. 4 showing the accessory bag completely removed from the main bag.
Figure 6:
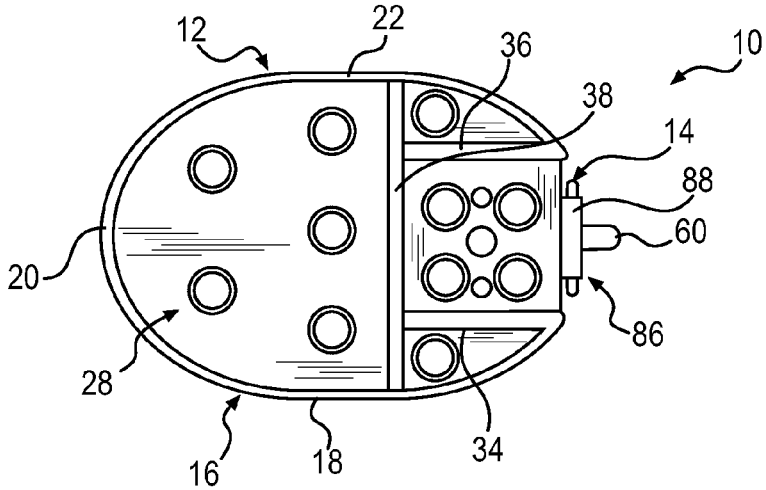
FIG. 6 is a top view of the golf bag showing the accessory bag positioned within the bag-receiver chamber of the main bag.

FIG. 3 illustrates accessory bag 14 positioned within main bag 12 so that retention pin 50 is positioned at termination point 58 of second channel 56. With retention pin 50 positioned at termination point 58 of second channel 56, both main bag 12 and accessory bag 14 can be simultaneously lifted by handle 60. When a user wishes to separate accessory bag 14 from main bag 12 the user pulls accessory bag 14 in direction 62 to cause retention pin 50 to travel through channels 56, 54 to release accessory bag 14, as shown, for example, in FIGS. 4 and 5. Retention pin 52 follows the same path in retention slot 48.

Figure 8:
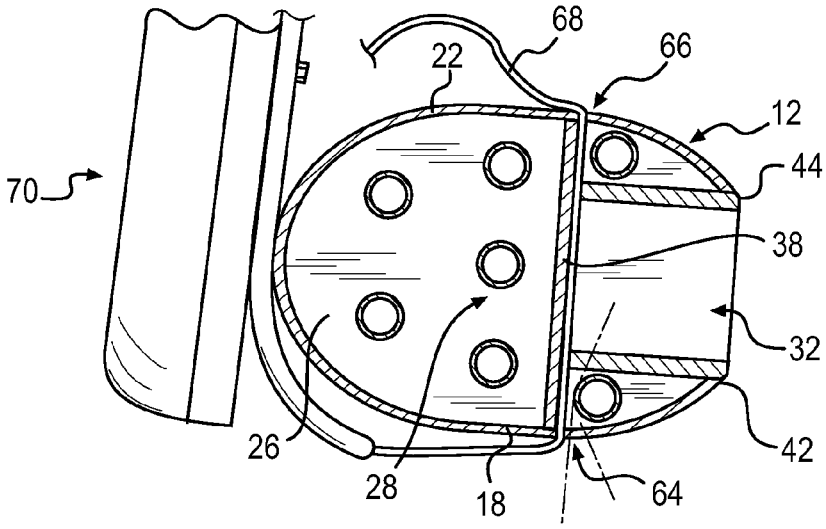
FIG. 8 is a top view of the golf bag secured to a golf cart and showing a bag retraining strap of the golf cart passing from a first side of the main bag through the bag-receiver chamber and out of the second side of the main bag to secure the main bag to the golf cart without restricting the movement of the accessory bag.

Main bag 12 also includes harness slots 64, 66, as shown in FIGS. 1 and 8. Harness slots 64, 66 are formed in first and second side walls 18, 22 of housing 16 and are adapted to accept a harness strap 68 of a golf cart 70 or other type of cart. Harness strap 68 of golf cart 70 is adapted to enter harness slot 64, pass along back wall 38 of bag-receiver chamber 32 and exit harness slot 66 to secure main bag 12 to golf cart 70. Securing main bag 12 in this fashion permits accessory bag 14 to be removed from main bag 12 without requiring the removal of main bag 12 from golf cart 70.

Accessory bag 14 is a stand alone golf bag that is designed to hold selected clubs that are used by golfers during their short game near a green. During a game of golf, a player, after completing their initial drive, may need one or more clubs as they approach the green. To finish play, a golfer may need their pitching wedge, sand wedge and/or putter. Accessory bag 14 allows the golfer to take three or four clubs with them while leaving the remaining clubs (eg. drivers and irons) and other items, such as extra balls, etc. in the golf cart 70.

Figure 7:
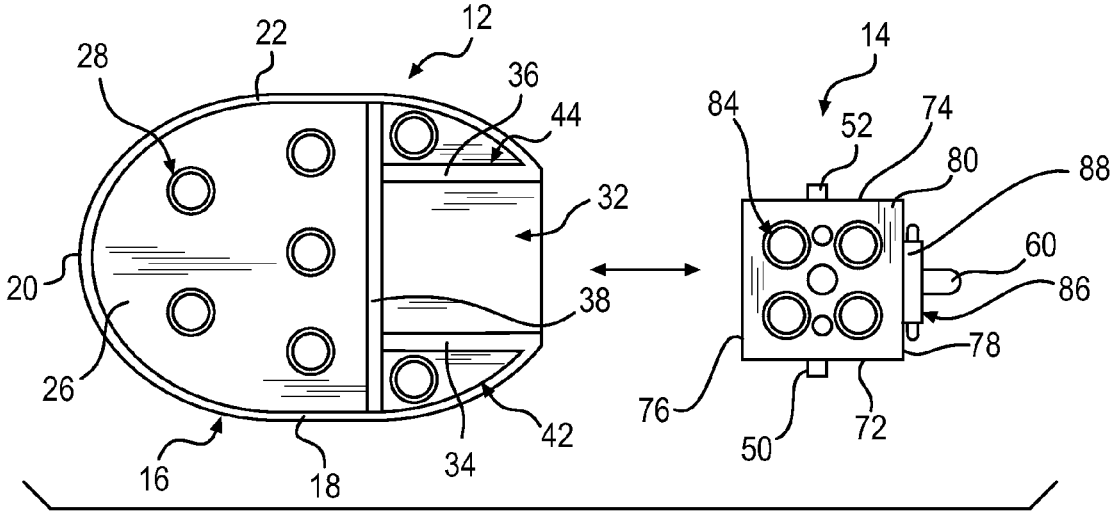
FIG. 7 is a top view of the golf bag showing the accessory bag removed from the bag-receiver chamber of the main bag.

Accessory bag 14 of golf bag 10 is shown as having side walls 72, 74, 76, 78, as shown in FIGS. 2 and 7. Accessory bag 14 also includes top wall 80 and bottom wall 82. Top wall 80 includes a series of openings 84 adapted to accept golf clubs 30. Side walls 72, 74 include retention pins 50, 52, which are used to secure accessory bag 14 to retention slots 42, 44 of main bag 12. While accessory bag 14 is shown having a square configuration, it can also be cylindrical or triangular.

Side wall 78 includes handle 60 and foldable leg assembly 86. Foldable leg assembly 86 is adapted to be folded up against side wall 78, as shown, for example, in FIG. 1. Foldable leg assembly 86 can also be extended outwardly to support either accessory bag 14, alone, as suggested in FIG. 2 or main bag 12, and accessory bag 14 together. Foldable leg assembly 86 includes a bracket 88, and first and second leg members 90, 92. Bracket 88 is configured to pivotally couple leg members 90, 92 to side wall 78 of accessory bag 14. Bracket 88 can be positioned either above or below handle 60.

First and second leg members 90, 92 can be telescopic and include a pair of feet 94, 96 that are adapted to engage the ground. Leg members 90, 92 are supported by supports 98, 100 to prevent accidental retraction of leg members 90, 92. As previously stated, leg members 90, 92 of foldable leg assembly 86 can support the combination of the main bag 12 and accessory bag 14 together or the accessory bag 14 by itself.

In use, the golfer places their clubs 30 in openings 28, 84 of main and accessory bags 12, 14. Preferably, the golfer places their putter, sand, and pitching wedges in openings 84 of accessory bag 14 and places the remainder of their clubs in main bag 12. The golfer, when loading golf bag 10 into their golf cart 70 places harness strap 68 into harness slot 64, past wall 38 and out harness slot 66 to secure golf bag 10 to cart 70. With golf bag 10 in position, the golfer can quickly remove accessory bag 14 from main bag 12 by lifting accessory bag 14 upwardly and outwardly to free retention pins 50, 52 from retention slots 42, 44 of main bag 12. Once accessory bag 14 is free from main bag 12, the golfer can carry accessory bag 14 with them to the green and deploy foldable leg assembly 86. With foldable leg assembly 86 deployed, the golfer can position accessory bag 14 in a tripod-type configuration and select a desired club from openings 84.

Figure 9:
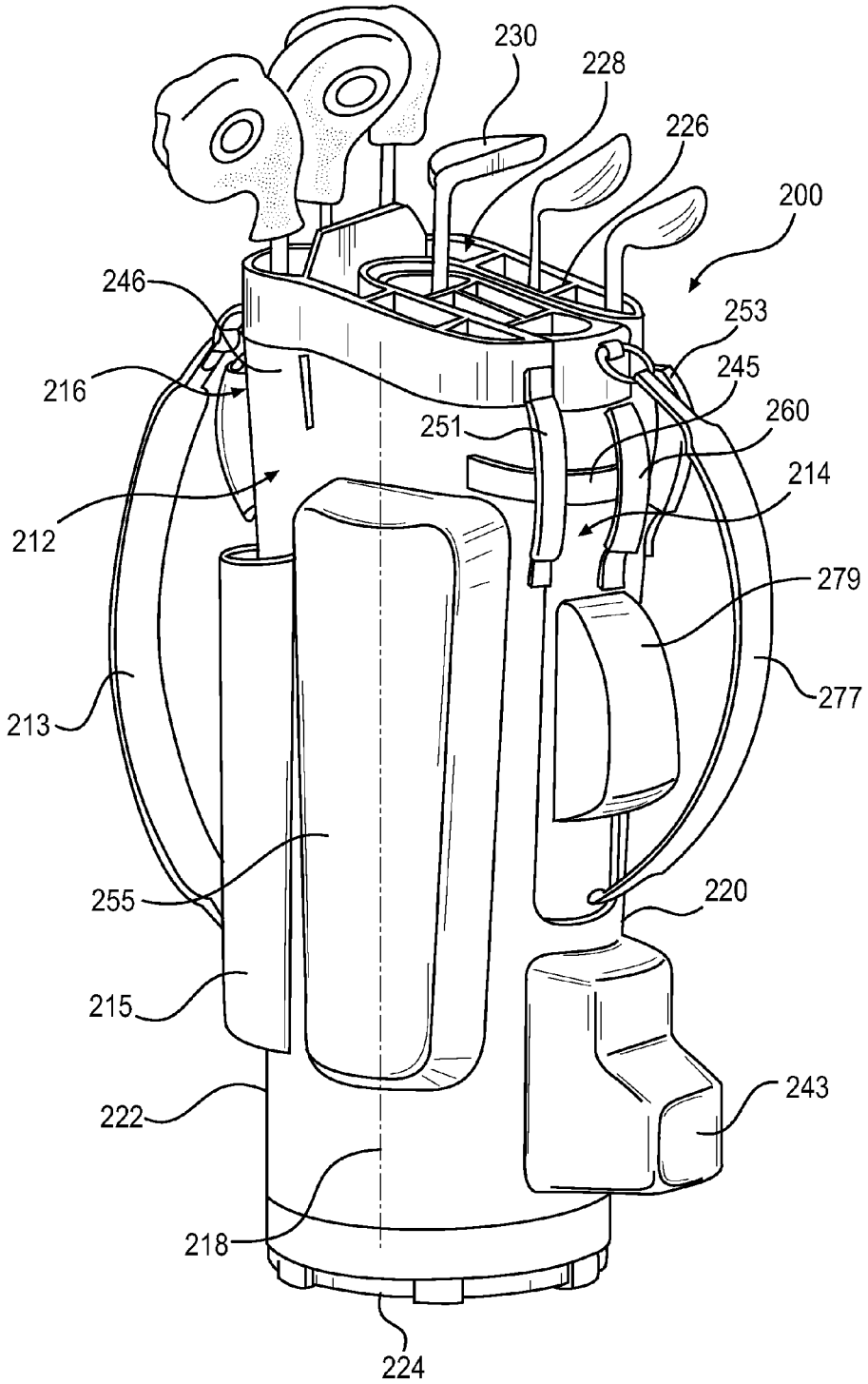
FIG. 9 is a perspective view of another embodiment of the golf bag showing a main bag and an accessory bag positioned within a bag-receiver chamber of the main bag, the main and accessory bags formed to include a series of openings to accept golf clubs and also showing the accessory bag having an arched handle and a shoulder strap.
Figure 10:
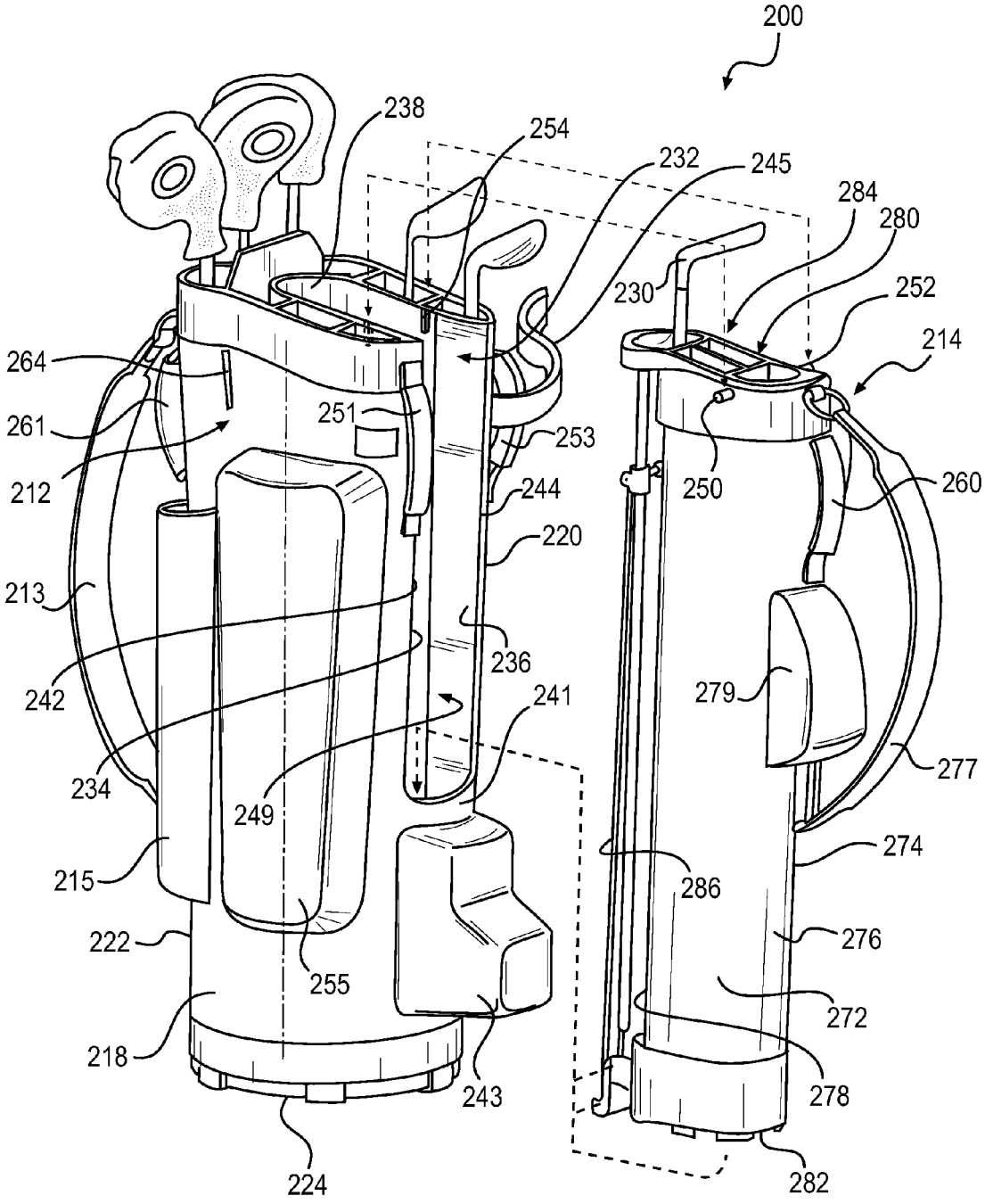
FIG. 10 is a perspective view of the golf bag of FIG. 9 showing the accessory bag removed from the bag-receiver chamber of the main bag.

In another embodiment, golf bag 200 is shown having a main bag 212 and an accessory bag 214 coupled to main bag 212, as shown, for example, in FIGS. 9 and 10. Main bag 212 includes a housing 216. Housing 216 of main bag 12 includes side walls 218, 220, 222 and bottom wall 224. Housing 216 of main bag 212 also includes a top side 226. Top side 226 includes a series of openings 228 that are adapted to accept the shafts of golf clubs 230. Housing 216 of main bag 212 also includes a bag-receiver chamber 232 that is adapted to accept accessory bag 214, as shown, for example, in FIG. 10.

Side wall 222 of main bag 212 includes shoulder strap 213 to allow a golfer to carry both the main bag 212 and accessory bag 214 on their shoulder. Side wall 222 of main bag 212 also includes an umbrella slot 215 for carrying a golfing umbrella.

Figure 11:
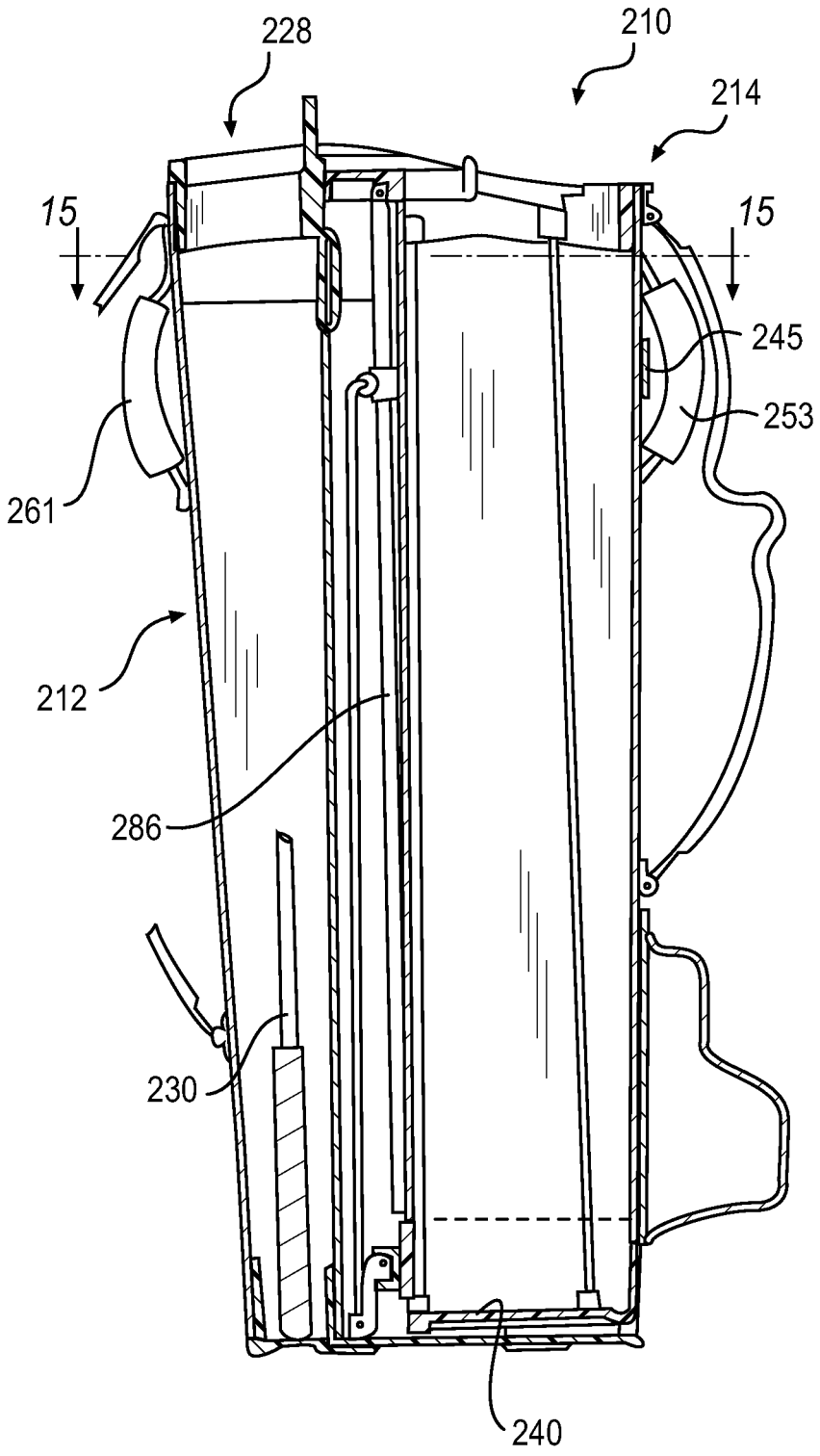
FIG. 11 is a side plan view of the golf bag with portions cut away to show the accessory bag positioned within the bag-receiver chamber of the main bag.
Figure 12:
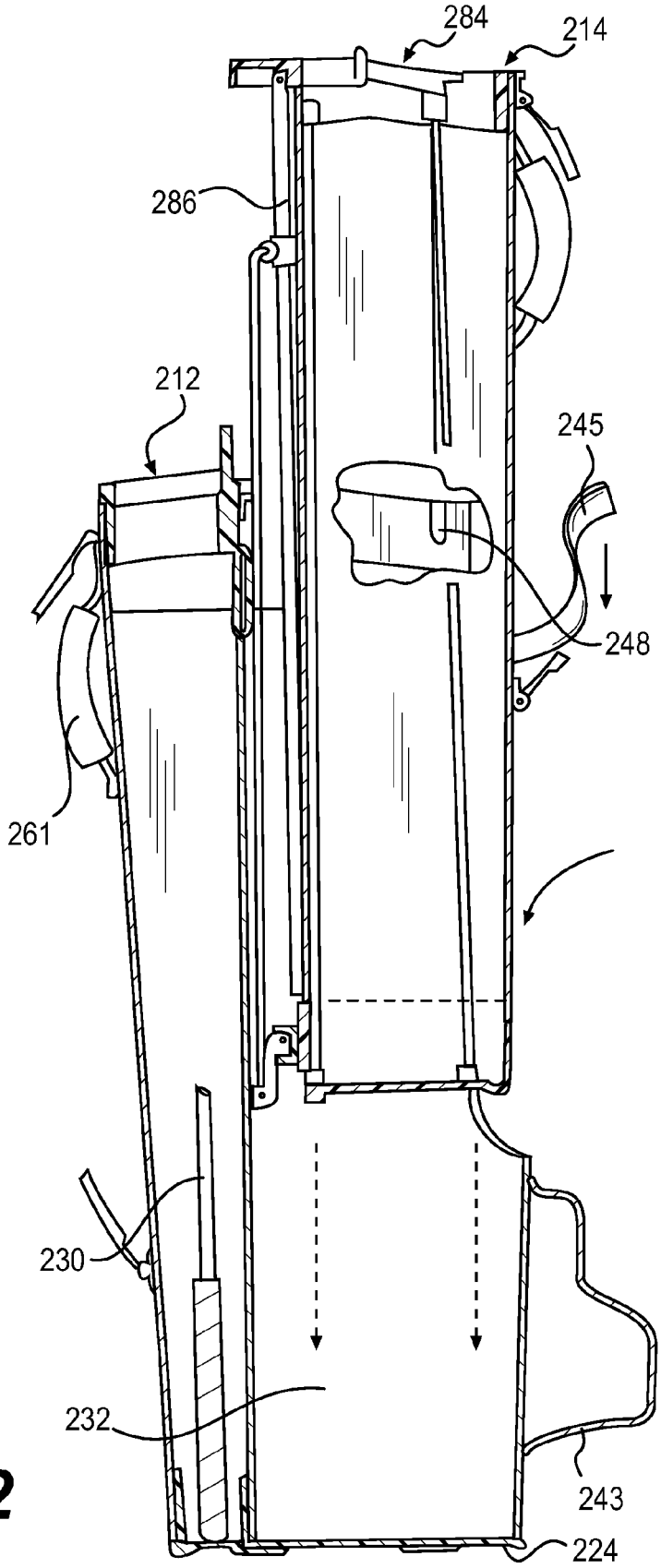
FIG. 12 is a side plan view of the golf bag showing the accessory bag in a raised position during the installation of the accessory bag into the main bag.

Bag-receiver chamber 232 of main bag 212 includes a first side wall 234, a second side wall 236, and a back wall 238, as shown in FIGS. 10 and 11. Bag-receiver chamber 232 of housing 216 also includes bottom wall 240. Walls 234, 236, 238, and 240 together form bag-receiver chamber 232 and are adapted to house accessory bag 214. Walls 234, 236 meet with side walls 218, 220 along leading edges 242, 244 to form elongated opening 249. Side walls 218, 220 include handles 251, 253 that allow a golfer to pick up main bag 212 and accessory bag 214 simultaneously to allow golf bag 210 to be placed within a golf cart 270. Side walls 218, 220 also include elongated bags 255, 257 configured to store golf related accessories.

While a rectangular chamber with a curved back wall 238 is shown, it is contemplated that a curved or triangular chamber can also be used to accommodate a complementary accessory bag of similar configuration. Main bag 212 also includes a partial front wall 241 that extends about a quarter of the way up the front of the main bag 212. Front wall 241 may include an accessory bag 243, as shown in FIGS. 9 and 10. Main bag 212 also includes a retention strap 245 that is adapted to assist in retaining the position of accessory bag 214 within bag-receiver chamber 232 of main bag 212. Retention strap 245 can be in the form of a Velcro strap, buckle strap, or a strap having other fastening means.

Figure 13:
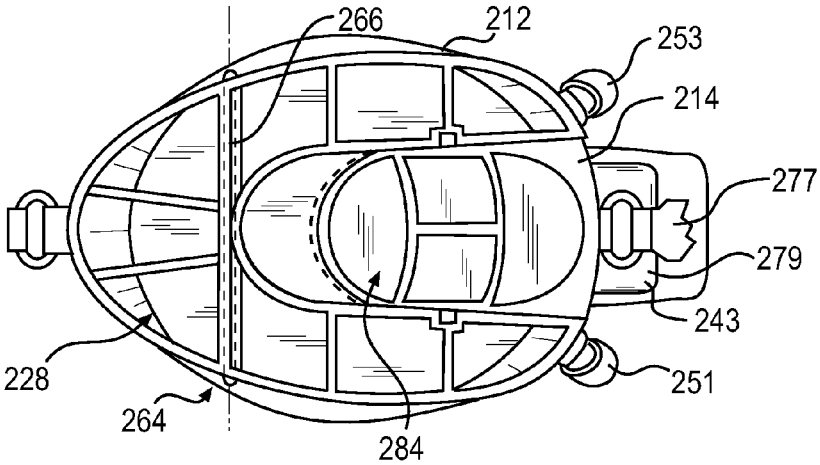
FIG. 13 is a top view of the golf bag showing the accessory bag positioned within the bag-receiver chamber of the main bag.
Figure 14:
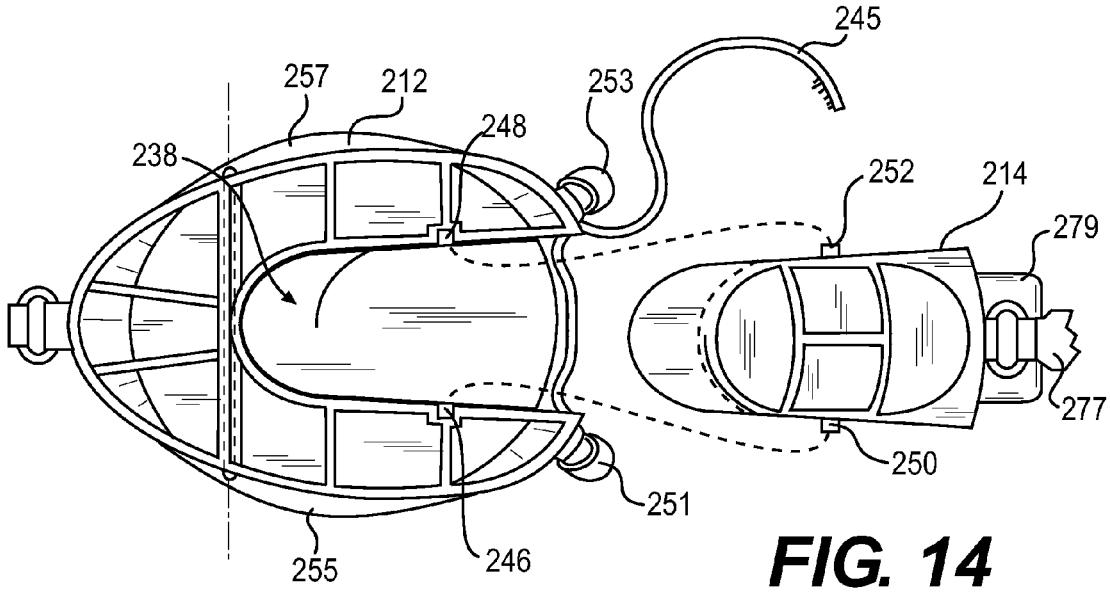
FIG. 14 is a top view of the golf bag showing the accessory bag removed from the bag-receiver chamber of the main bag.

Walls 234, 236 of main bag 212 each include retention slots 246, 248 as shown in FIGS. 13 and 14. Retention slots 246, 248 are adapted to accept retention pins 250, 252 that extend from accessory bag 214. Each of retention slots 246, 248 is formed to include a channel 254, as shown in FIG. 10. Channel 254 extends from the top of main bag 212 and extends in a substantially vertical direction.

FIG. 10 illustrates the placement of accessory bag 214 within main bag 212 so that retention pins 250, 252 will be positioned within retention slots 246, 248. With retention pins 250, 252 positioned with retention slots 246, 248, both main bag 212 and accessory bag 214 can be simultaneously lifted by handle 261 of main bag 212. When a user wishes to separate accessory bag 214 from main bag 212 the user releases retention strap 245 and pulls accessory bag 214 upwardly and outwardly to separate accessory bag 214, as shown, for example, in FIGS. 13 and 14.

Figure 15:
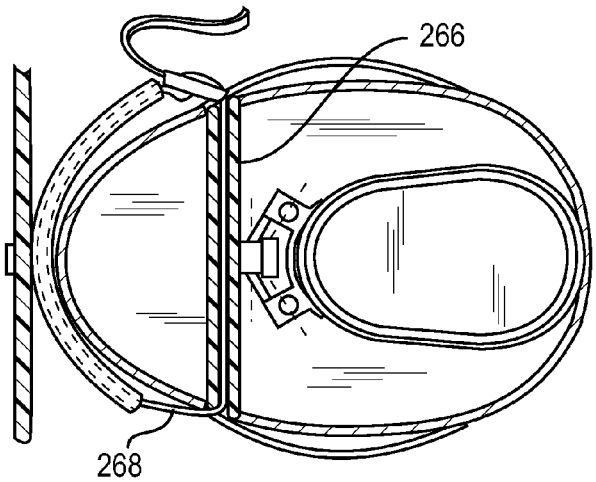
FIG. 15 is a sectional view of the golf bag taken along line 15-15 of FIG. 11.

Main bag 212 also includes harness slot 264, as shown in FIGS. 9 and 15. Harness slot 264 is formed in first and second side walls 218, 222 of housing 216 and is part of elongated tube 266, which passes through housing 216. Harness 264 is adapted to accept a harness strap 268 of a golf cart 270 or other type of cart. Harness strap 268 of golf cart 270 is adapted to enter harness slot 264, pass through elongated tube 266 and exit out the other side to secure main bag 212 to golf cart 270. Securing main bag 212 in this fashion permits accessory bag 214 to be removed from main bag 212 without requiring the removal of main bag 212 from golf cart 270.

Accessory bag 214 of golf bag 210 is shown as having side walls 272, 274, 276, 278, as shown in FIG. 10. Accessory bag 214 also includes top side 280 and bottom wall 282. Top wall 280 includes a series of openings 284 adapted to accept golf clubs 230. Side walls 272, 274 include retention pins 250, 252, which are used to secure accessory bag 214 to retention slots 246, 248 of main bag 212. While accessory bag 214 is shown having an oval configuration, it can also be cylindrical or triangular.

Side wall 276 includes handle 260 and side wall 278 includes foldable leg assembly 286. Side wall 276 also includes shoulder strap 277, to allow accessory bag 214 to be carried on a golfer's shoulder. Side wall 276 also includes small pouch bag 279 used for storing tees, golf balls and the like. Foldable leg assembly 286 is adapted to be folded up against side wall 278, as shown, for example, in FIG. 10. Foldable leg assembly 286 can also be extended outwardly to support accessory bag 214. When accessory bag 214 is positioned in bag-receiver chamber 232, foldable leg assembly 286 is positioned inboard and concealed from view. Foldable leg assembly 286 includes a bracket 288, and first and second leg members 290, 292. Bracket 288 is configured to pivotally couple leg members 290, 292 to side wall 278 of accessory bag 214.

Figure 17:
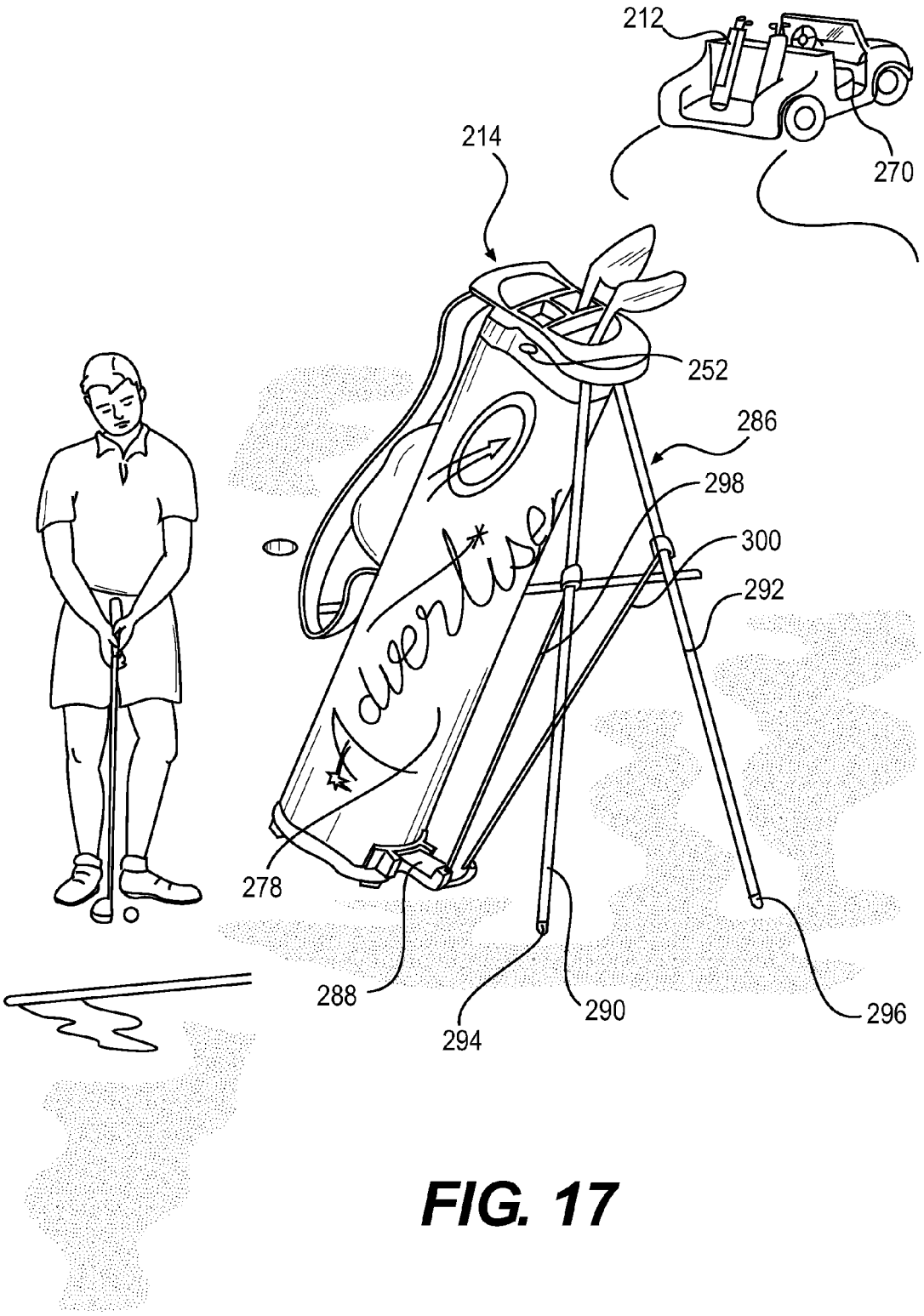
FIG. 17 is a perspective view of the accessory bag set up by a green while the main bag remains fastened in the golf cart.

First and second leg members 290, 292 pivot outwardly and include a pair of feet 294, 296 that are adapted to engage the ground. Leg members 290, 292 are supported by supports 298, 300 to prevent accidental retraction of leg members 290, 292. Leg members 290, 292 of foldable leg assembly 286 can support the accessory bag 214. Side walls of accessory bag 214 can also include advertisement so that corporate endorsements can be positioned near the green during professional tournament play, as shown in FIG. 17.

Figure 16:
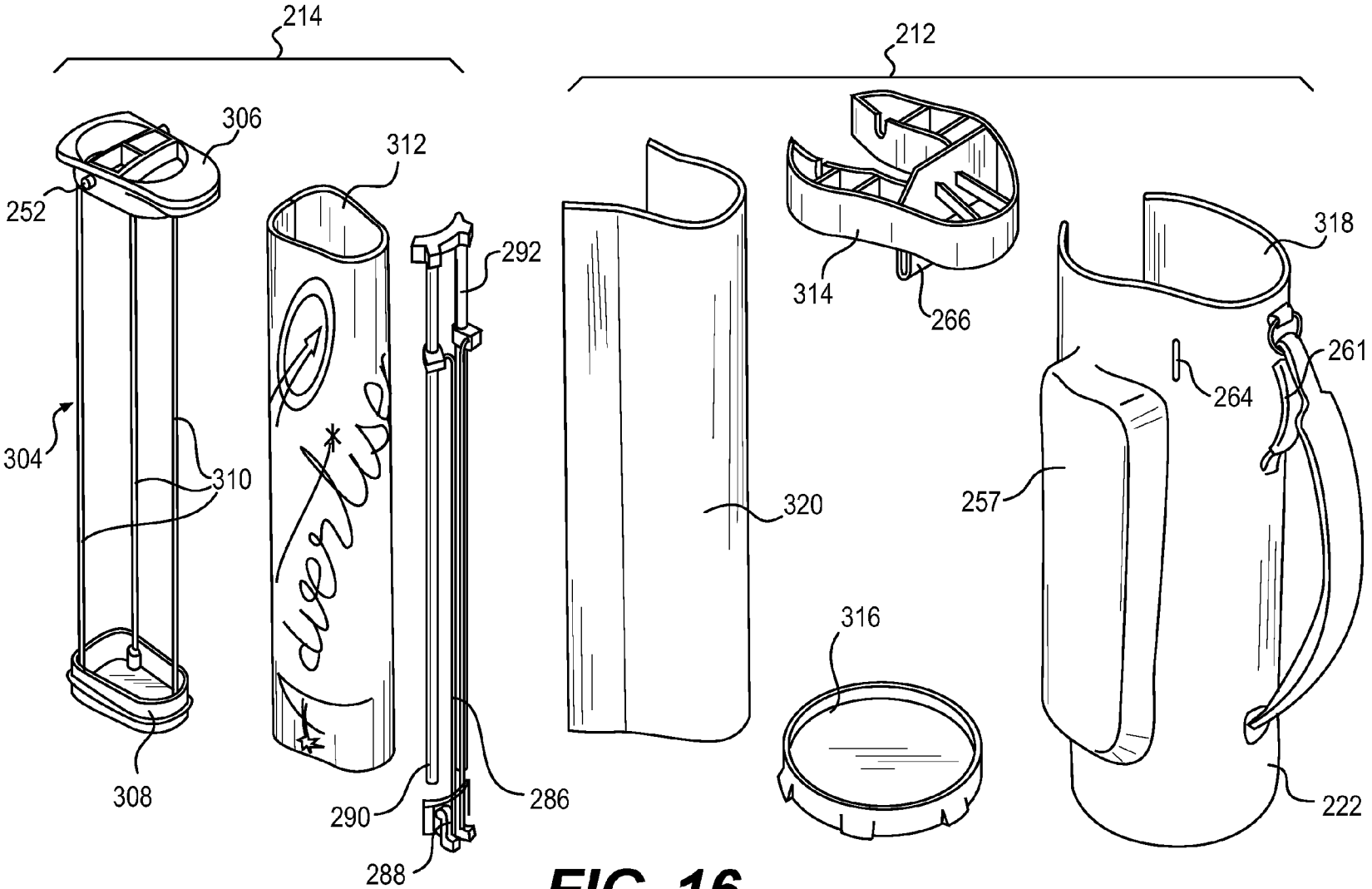
FIG. 16 is an exploded view of the golf bag showing the main bag and the accessory bag.

FIG. 16 shows an exploded view of golf bag 210. From left to right, FIG. 16 shows frame 304 of accessory bag 214, which includes top plate 306, spaced apart bottom plate 308 and support rods 310, which couple top plate 306 to bottom plate 308. Also shown is housing 312, which is configured to be coupled to plates 306, 308. Folding leg assembly 286 is also adapted to be coupled to frame 304. Main bag 212 includes upper plate 314 and spaced apart bottom plate 316, which are coupled by shell 318. Main bag 212 also include chamber wall 320, which fits inside of shell 318.

Various features of the disclosure have been shown and described in connection with the illustrated embodiment, however, it is understood that these arrangements merely illustrate, and that the disclosure is to be given its fullest interpretation.

What is claimed is:

1. A golf bag for holding golf clubs comprising:

a main bag including a housing, the housing including a plurality of side walls, a bottom wall, a top opening and a partial front wall extending at least about a quarter of the way up from the bottom wall;

a bag-receiver chamber formed in the main bag, the bag-receiver chamber including an interior wall within the main bag and including an elongated opening formed in the main bag, the elongated opening extending downward from the top opening of the main bag to an upper edge of the partial front wall;

an accessory bag including plurality of side walls and a top wall configured to receive golf clubs to be retained in the accessory bag; and wherein the elongated opening and the top opening are configured to cooperate to receive the accessory bag therethrough and the accessory bag is removable from the main bag through the elongated opening and top opening by an upward and outward movement of the accessory bag over the upper edge of the partial front wall; and wherein one of the accessory bag and the main bag includes posts and the other bag includes receptacles that cooperate to assist in retaining the accessory bag in the main bag when the accessory bag is positioned within the bag-receiver chamber of the main bag.

2. The golf bag of claim 1, further comprising an accessory pouch disposed on the partial front wall, the accessory pouch being located between the upper edge of the partial front wall and the bottom wall of the main bag.

3. The golf bag of claim 1, wherein the main bag includes a retention strap that is configured to extend across the elongated opening to secure the accessory bag within the bag-receiver chamber.

4. The golf bag of claim 1, wherein the housing of the main bag is formed to include first and second slots on opposite side walls of the main bag, the slots adapted to receive a strap from a golf cart to secure the main bag to the golf cart while permitting the accessory bag to be separated from the main bag.

5. The golf bag of claim 4, wherein the main bag includes an elongated tube that forms a pathway for the strap of the golf cart through the main bag.

6. The golf bag of claim 1, wherein the accessory bag includes a leg support that, when extended, supports the accessory bag in a substantially upright configuration.

7. The golf bag of claim 6, wherein the leg support of the accessory bag is within the bag-receiver chamber and concealed from view when the accessory bag is positioned within the bag-receiver chamber of the main bag.

8. The golf bag of claim 1, wherein the accessory bag includes an advertisement displayed on one of the plurality of side walls of the accessory bag.

9. A golf bag for holding golf clubs comprising:

a main bag including a housing, the housing including a plurality of side walls, a bottom wall, a top opening and a partial front wall extending at least about a quarter of the way up from the bottom wall;

a bag-receiver chamber formed in the main bag, the bag-receiver chamber including an interior wall within the main bag and including an elongated opening formed in the main bag, the elongated opening extending downward from the top opening of the main bag to an upper edge of the partial front wall;

an accessory bag including plurality of side walls and a top wall configured to receive golf clubs to be retained in the accessory bag, the elongated opening and the top opening are configured to cooperate to receive the accessory bag therethrough and the accessory bag is removable from the main bag through the elongated opening and top opening by an upward and outward movement of the accessory bag over the upper edge of the partial front wall; and wherein the accessory bag includes a leg support that has an extended and a collapsed position such that when the leg support is extended it supports the accessory bag in an upright configuration and when the leg support is collapsed it can be stored with the accessory bag in the bag-receiver chamber such that the leg support is positioned adjacent the interior wall of the bag-receiver chamber and is concealed from view.

10. The golf bag of claim 9, wherein one of the accessory bag and the main bag includes posts and the other bag includes receptacles that cooperate to assist in retaining the accessory bag in the main bag when the accessory bag is positioned within the bag-receiver chamber of the main bag.

11. The golf bag of claim 9, further comprising an accessory pouch disposed on the partial front wall, the accessory pouch being located between the upper edge of the partial front wall and the bottom wall of the main bag.

12. The golf bag of claim 9, wherein the main bag includes a retention strap that is configured to extend across the elongated opening to secure the accessory bag within the bag-receiver chamber.

13. The golf bag of claim 9, wherein the housing of the main bag is formed to include first and second slots on opposite side walls of the main bag, the slots adapted to receive a strap from a golf cart to secure the main bag to the golf cart while permitting the accessory bag to be separated from the main bag.

14. The golf bag of claim 13, wherein the main bag includes an elongated tube that forms a pathway for the strap of the golf cart through the main bag.

15. The golf bag of claim 9, wherein the accessory bag includes an advertisement displayed on one of the plurality of side walls of the accessory bag.

16. A golf bag for holding golf clubs comprising:

a main bag including a housing, the housing including a plurality of side walls, a bottom wall, a top opening and a partial front wall extending at least about a quarter of the way up from the bottom wall;

a bag-receiver chamber formed in the main bag, the bag-receiver chamber including an interior wall within the main bag and including an elongated opening formed in the main bag, the elongated opening extending downward from the top opening of the main bag to an upper edge of the partial front wall;

an accessory bag including plurality of side walls and a top wall configured to receive golf clubs to be retained in the accessory bag; and wherein the elongated opening and the top opening are configured to cooperate to receive the accessory bag therethrough and the accessory bag is removable from the main bag through the elongated opening and top opening by an upward and outward movement of the accessory bag over the upper edge of the partial front wall; and wherein the accessory bag and the main bag include a retainer oriented to secure the accessory bag within the main bag such that when the accessory bag is secured in the main bag the accessory bag can be used to lift the main bag when the accessory bag is positioned within the bag-receiver chamber of the main bag.

* * * * *